US009104138B2

(12) United States Patent
Sato

(10) Patent No.: US 9,104,138 B2
(45) Date of Patent: Aug. 11, 2015

(54) DEVELOPING DEVICE

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/493,421

(22) Filed: Sep. 23, 2014

(65) Prior Publication Data

US 2015/0093144 A1 Apr. 2, 2015

(30) Foreign Application Priority Data

Sep. 30, 2013 (JP) ..... 2013-205816

(51) Int. Cl.
*G03G 15/08* (2006.01)

(52) U.S. Cl.
CPC ..... *G03G 15/0881* (2013.01); *G03G 15/0817* (2013.01)

(58) Field of Classification Search
CPC ..... G03G 15/0817
See application file for complete search history.

(56) References Cited

U.S. PATENT DOCUMENTS

| | | | | |
|---|---|---|---|---|
| 6,295,425 | B1 * | 9/2001 | Garcia et al. | 399/103 |
| 6,792,227 | B2 | 9/2004 | Itabashi | |
| 2002/0141778 | A1 | 10/2002 | Itabashi | |
| 2013/0236209 | A1 * | 9/2013 | Furuichi | 399/103 |

FOREIGN PATENT DOCUMENTS

| | | | |
|---|---|---|---|
| JP | H08-202149 | A | 8/1996 |
| JP | 2002-287488 | A | 10/2002 |
| JP | 2012-118189 | A | 6/2012 |

* cited by examiner

*Primary Examiner* — G. M. Hyder
(74) *Attorney, Agent, or Firm* — Banner & Witcoff, Ltd.

(57) ABSTRACT

There is provided a developing device including a developing roller, a housing configured to support the developing roller, a first seal member arranged between the developing roller and the housing at each end portion of the developing roller in an axial direction thereof, and a second seal member arranged between the developing roller and the housing at an inner side of each first seal member in the axial direction and having a smaller frictional force per unit area to be applied with respect to the developing roller than the first seal member.

15 Claims, 8 Drawing Sheets

DEVELOPING DEVICE

CROSS-REFERENCE TO RELATED APPLICATION

This application claims priority from Japanese Patent Application No. 2013-205816, filed on Sep. 30, 2013, the entire subject matter of which is incorporated herein by reference.

TECHNICAL FIELD

Aspects of the present invention relate to a developing device including a developing roller.

BACKGROUND

There has been known a developing device provided for an electro-photographic image forming apparatus. The developing device includes a developing roller, a housing configured to support the developing roller, and a seal member arranged between the developing roller and the housing at each end portion of the developing roller in an axial direction.

For example, JP-A-2002-287488 discloses a seal member provided for the developing device. This seal member includes a first seal member and a second seal member which has the same configuration as the first seal member and is arranged at an inner side of the first seal member in an axial direction of the developing roller.

SUMMARY

However, in the above configuration, at a contact part of the second seal member and the developing roller, developer is melted by frictional heat generated from the contact part, and the melted developer may be affixed to the second seal member. If the developer is affixed to the second seal member, the developing roller may be ground by the affixed developer, and the developer may be leaked from the ground part.

Accordingly, an aspect of the present invention provides a developing device capable of suppressing developer from being affixed to a seal member and preventing the developer from being leaked.

According to an illustrative embodiment of the present invention, there is provided a developing device comprising: a developing roller; a housing configured to support the developing roller; a first seal member arranged between the developing roller and the housing at each end portion of the developing roller in an axial direction thereof; and a second seal member arranged between the developing roller and the housing at an inner side of each first seal member in the axial direction and having a smaller frictional force per unit area to be applied with respect to the developing roller than the first seal member.

According to the above configuration, since the frictional force is smaller at a contact part of the second seal member and the developing roller, it is possible to suppress developer from being melted and affixed to the second seal member due to frictional heat generated from the contact part. Thereby, it is possible to suppress the developing roller from being ground and the developer from being leaked from the ground part. Further, even though the developer is leaked through the contact part of the second seal member and the developing roller, it is possible to block the leaked developer by the first seal member, so that it is possible to prevent the developer from being leaked to an outside.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, illustrative embodiments of the present invention will be specifically described with reference to the drawings. In the below, an overall configuration of a multi-function machine 1 including a developing cartridge 100 (an example of a developing device) will be first described, and then, a detailed configuration of the developing cartridge 100 will be described.

In the below, directions are described based on a user who uses the multi-function machine 1. That is, in FIG. 1, a right side of the sheet is referred to as a front side, a left side of the sheet is referred to as a rear side, a back side of the sheet is referred to as a right side and a front side of the sheet is referred to as a left side. A vertical direction of the sheet is referred to as an upper-lower direction.

Overall Configuration of Multi-Function Machine

Figure 1:
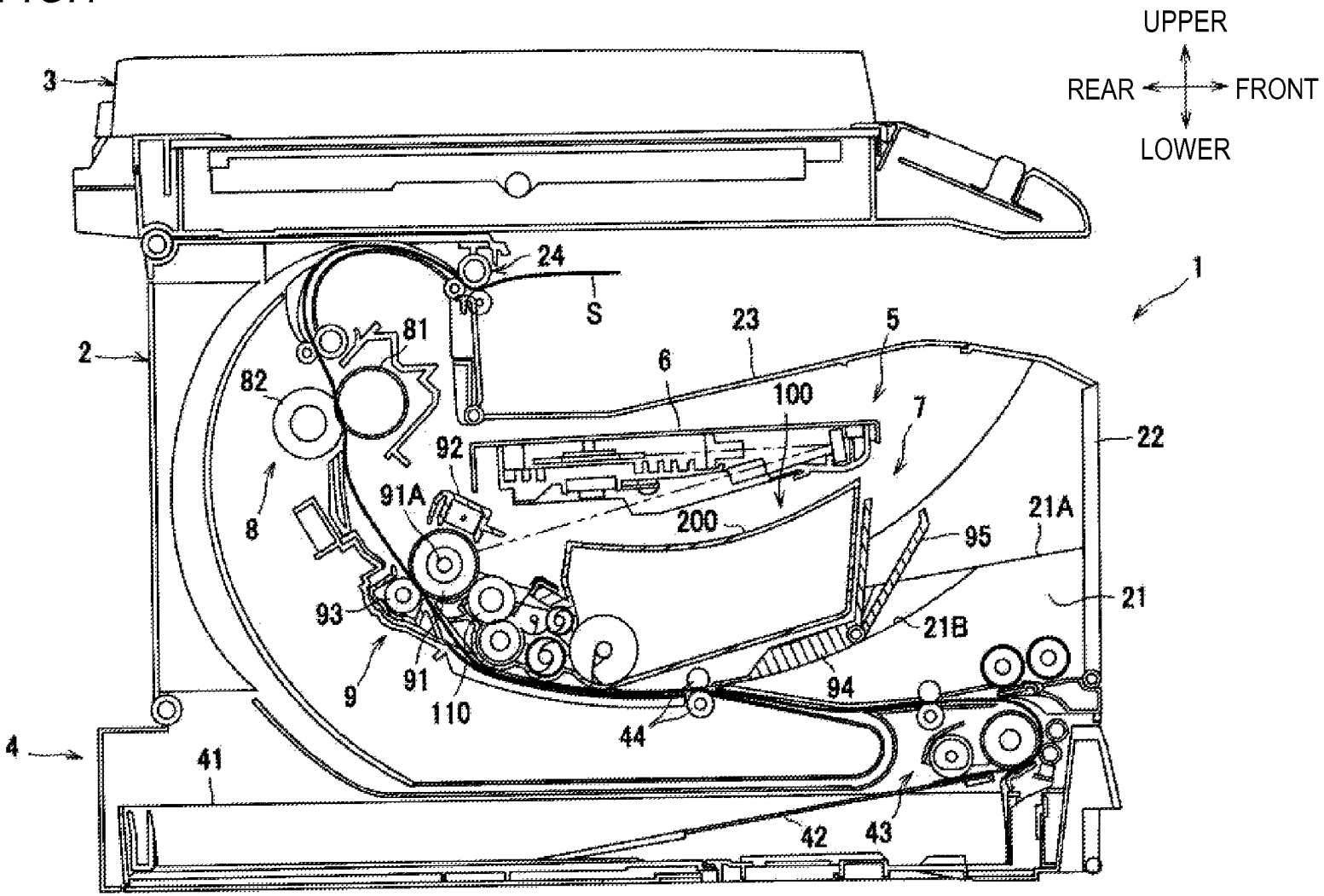
FIG. 1 is a view showing a schematic configuration of a multi-function machine including a developing cartridge according to an illustrative embodiment of the present invention.

As shown in FIG. 1, the multi-function machine 1 includes a main body frame 2 and an image reading device 3 provided above the main body frame 2. The multi-function machine 1 includes, in the main body frame 2, a feeder unit 4 configured to feed a sheet S and an image forming unit 5 configured to form an image on the fed sheet S.

The main body frame 2 includes side frames 21 (only the right side frame is shown in FIG. 1) arranged at the left and right sides of the image forming unit 5, and a front cover 22 configured to cover a mounting opening 2A (refer to FIG. 2) formed on a front surface of the main body frame 2. Also, the main body frame includes a sheet discharge tray 23, on which the sheet S discharged from the main body frame 2 is received, at an upper part thereof.

The image reading device 3 is provided above the sheet discharge tray 23. The image reading device 3 has a known configuration and generates image data by illuminating light to a set document and reading an image thereof when performing a copy operation, for example.

The feeder unit 4 is provided at a lower part in the main body frame 2, and includes a sheet feeding tray 41, a sheet pressing plate 42, a sheet feeding mechanism 43, and a pair of registration rollers 44. In the feeder unit 4, the sheet S accommodated in the sheet feeding tray 41 is inclined upwardly towards the sheet feeding mechanism 43 by the sheet pressing plate 42 and is fed towards the registration rollers 44 by the sheet feeding mechanism 43.

The pair of registration rollers 44 are provided at a further downstream side than the sheet feeding mechanism 43 in a conveyance direction of the sheet S and regulates a leading end position of the sheet S conveyed by the sheet feeding mechanism 43. The pair of registration rollers 44 form a nip portion therebetween as one roller is urged towards the other roller. That is, the pair of registration rollers once regulate a leading end of the sheet S to be conveyed at a stationary state to thus align the leading end position of the sheet S and then convey the sheet S towards the image forming unit 5 (between a photosensitive drum 91 and a transfer roller 93).

The image forming unit 5 is provided above the feeder unit 4 and includes an exposure device 6, a process cartridge 7 configured to transfer a toner image onto the sheet S, and a fixing device 8 configured to heat-fix the toner image on the sheet S.

The exposure device 6 is arranged at an upper part in the main body frame 2 and includes a laser light emitting unit (not shown), a polygon mirror, a lens, a reflector and the like whose reference numerals are omitted. In the exposure device 6, a laser light (refer to the dashed-dotted line), which is emitted from the laser light emitting unit based on image data, is scanned on a surface of the photosensitive drum 91 at high speed, thereby exposing the surface of the photosensitive drum 91.

The process cartridge 7 is arranged below the exposure device 6 and includes a drum unit 9 and a developing cartridge 100.

The drum unit 9 includes the photosensitive drum 91, a charger 92, the transfer roller 93 and a drum frame 94 configured to hold these members.

The drum frame 94 is configured to support the photosensitive drum 91, the charger 92 and the transfer roller 93 and to accommodate therein the developing cartridge 100 at a front side of the photosensitive drum 91. The drum frame 94 is configured to rotatably support one of the pair of registration rollers 44 at the lower part of the developing cartridge 100. The drum frame 94 includes a gripping part 95 at a front end thereof.

In the drum unit 9, both left and right end portions of a shaft part 91A of the photosensitive drum 91 and both left and right end portions of the registration rollers 44 protrude outwardly from left and right side walls (not shown) of the drum frame 94 in the left-right direction.

The developing cartridge 100 is configured to be removably mounted to the drum unit 9, and includes a developing roller 110, a developing frame 200 (an example of the housing) configured to accommodate therein toner T (an example of a developer), and the like. The configuration of the developing cartridge 100 will be described later in detail.

Figure 2:
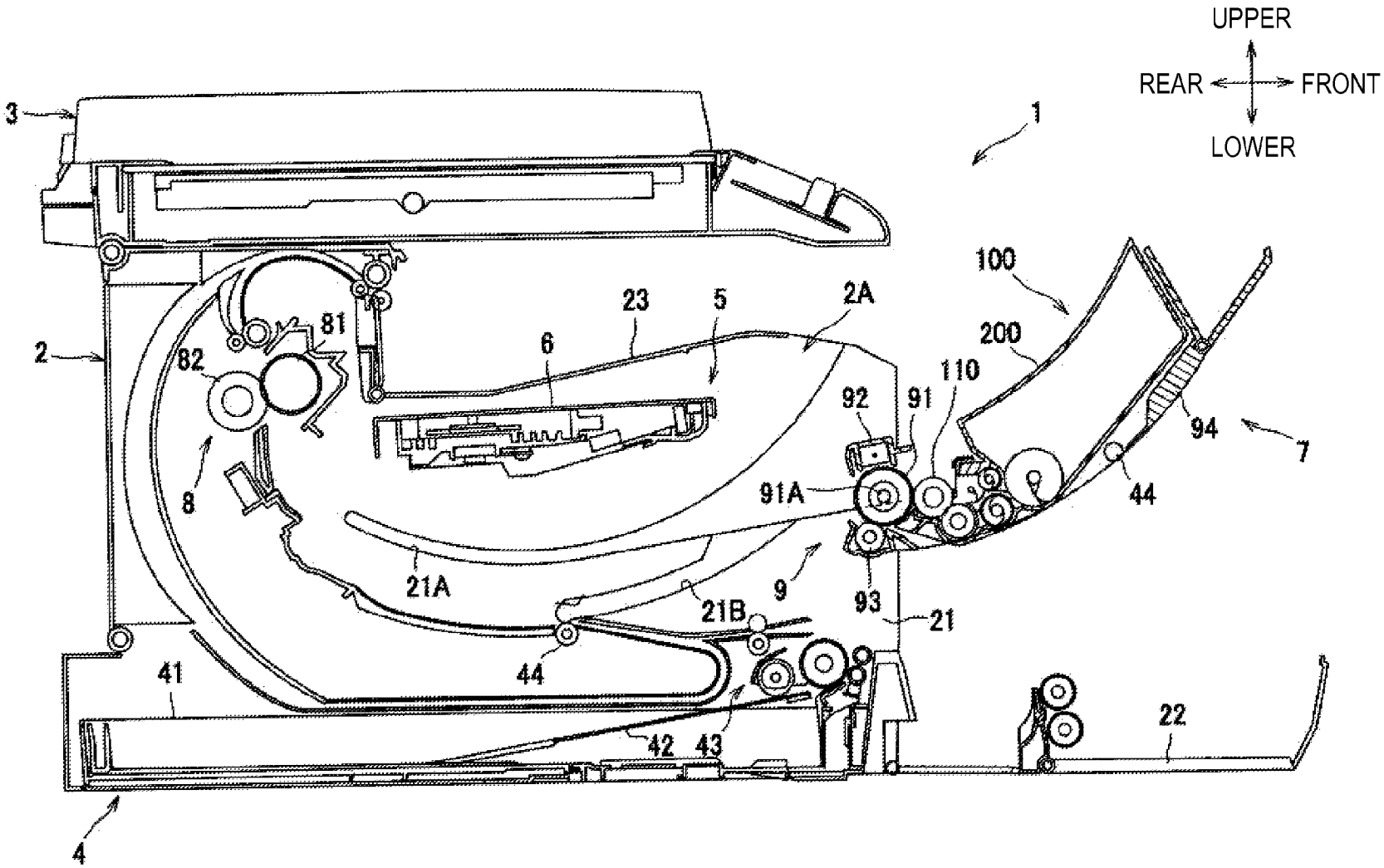
FIG. 2 shows a state where the developing cartridge of the multi-function machine is removed.

As shown in FIG. 2, the process cartridge 7 includes the drum unit 9 and developing cartridge 100 and can be integrally mounted and removed to and from the main body frame 2 through the mounting opening 2A which is formed when opening the front cover 22.

Specifically, the side frame 21 is provided with a first guide 21A and a second guide 21B. The first guide 21A is a recess which extends from an edge of the mounting opening 2A towards the inner side (rear side) of the main body frame 2 and has a width gradually narrowed towards the inner side (rear side). The first guide 21A has an arc shape with a rear end directing upwardly. The second guide 21B is a recess which is branched from the first guide 21A and extends towards the inner side (rear side) of the main body frame 2 below the first guide 21A.

The process cartridge 7 is mounted and removed to and from the main body frame 2 with changing a posture thereof between a state (refer to FIG. 2) where a rear part thereof at which the photosensitive drum 91 is provided faces downwardly and a state (refer to FIG. 1) where the rear part faces upwardly by moving the shaft part 91A of the photosensitive drum 91 along the first guide 21A and moving the registration rollers 44 along the second guide 21B while gripping the gripping part 95.

As shown in FIG. 1, in the process cartridge 7, a surface of the rotated photosensitive drum 91 is uniformly charged by the charger 92 and is then exposed by the high-speed scanning of the laser light from the exposure device 6. Thereby, a potential of the exposed part is lowered, so that an electrostatic latent image based on image data is formed on the surface of the photosensitive drum 91.

Then, the toner T is supplied to the electrostatic latent image on the photosensitive drum 91 by the developing roller 110, so that a toner image is formed on the surface of the photosensitive drum 91. Thereafter, the sheet S is conveyed between the photosensitive drum 91 and the transfer roller 93, so that the toner image carried on the surface of the photosensitive drum 91 is transferred onto the sheet S.

The fixing device 8 is arranged at a rear-upper part of the process cartridge 7 and includes a heating roller 81 and a pressing roller 82 configured to press the heating roller 81. In the fixing device 8, the toner image transferred on the sheet S is heat-fixed while the sheet S passes between the heating roller 81 and the pressing roller 82. The sheet S having the toner image heat-fixed thereon is discharged onto the sheet discharge tray 23 by discharge rollers 24.

Detailed Configuration of Developing Cartridge

Next, the detailed configuration of the developing cartridge 100 is described.

Figure 3:
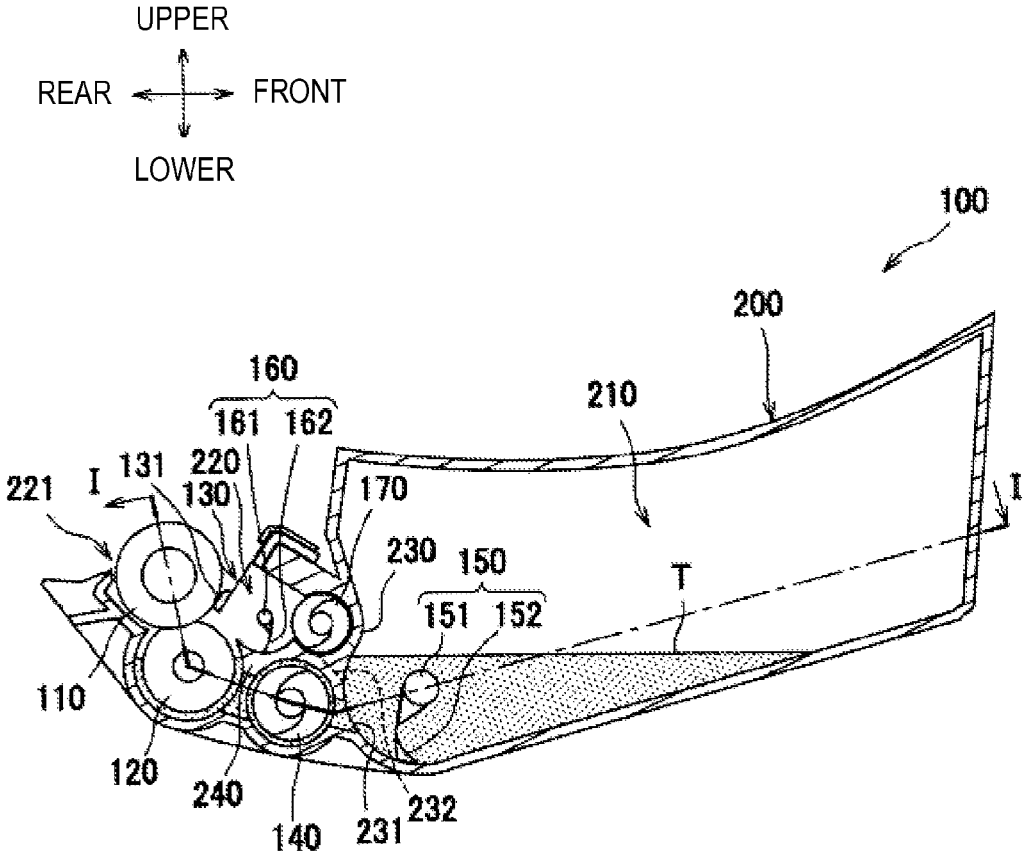
FIG. 3 is a sectional view of the developing cartridge.

As shown in FIG. 3, the developing frame 200 includes a toner accommodation unit 210 configured to accommodate therein the toner T and a developing unit 220 protruding rearwards from a rear wall of the toner accommodation unit 210 and having an opening 221 at an upper part thereof. A partition wall 230 configuring the rear wall of the toner accommodation unit 210 and a front wall of the developing unit 220 is provided between the toner accommodation unit 210 and the developing unit 220.

The developing cartridge 100 includes a rotating member 150 at the toner accommodation unit 210. The developing cartridge 100 includes the developing roller 110, a supply roller 120, a layer thickness regulation blade 130, a first auger 140 (an example of a first conveying member), a return conveyance member 160 (an example of a second conveying member), and a second auger 170 at the developing unit 220.

The partition wall 230 includes a partition 240 (an example of a wall) which extends rearwards from a substantially center portion in the upper-lower direction. Thereby, a space at a side of the partition wall 230 of the developing unit 220 is vertically divided by the partition 240.

Also, the partition wall 230 includes a first communication hole 231 configured to communicate the toner accommodation unit 210 and a space at a lower side than the partition 240 of the developing unit 220 each other and a second communication hole 232 configured to communicate the toner accommodation unit 210 and a space at an upper side than the partition 240 of the developing unit 220 each other.

Figure 4:
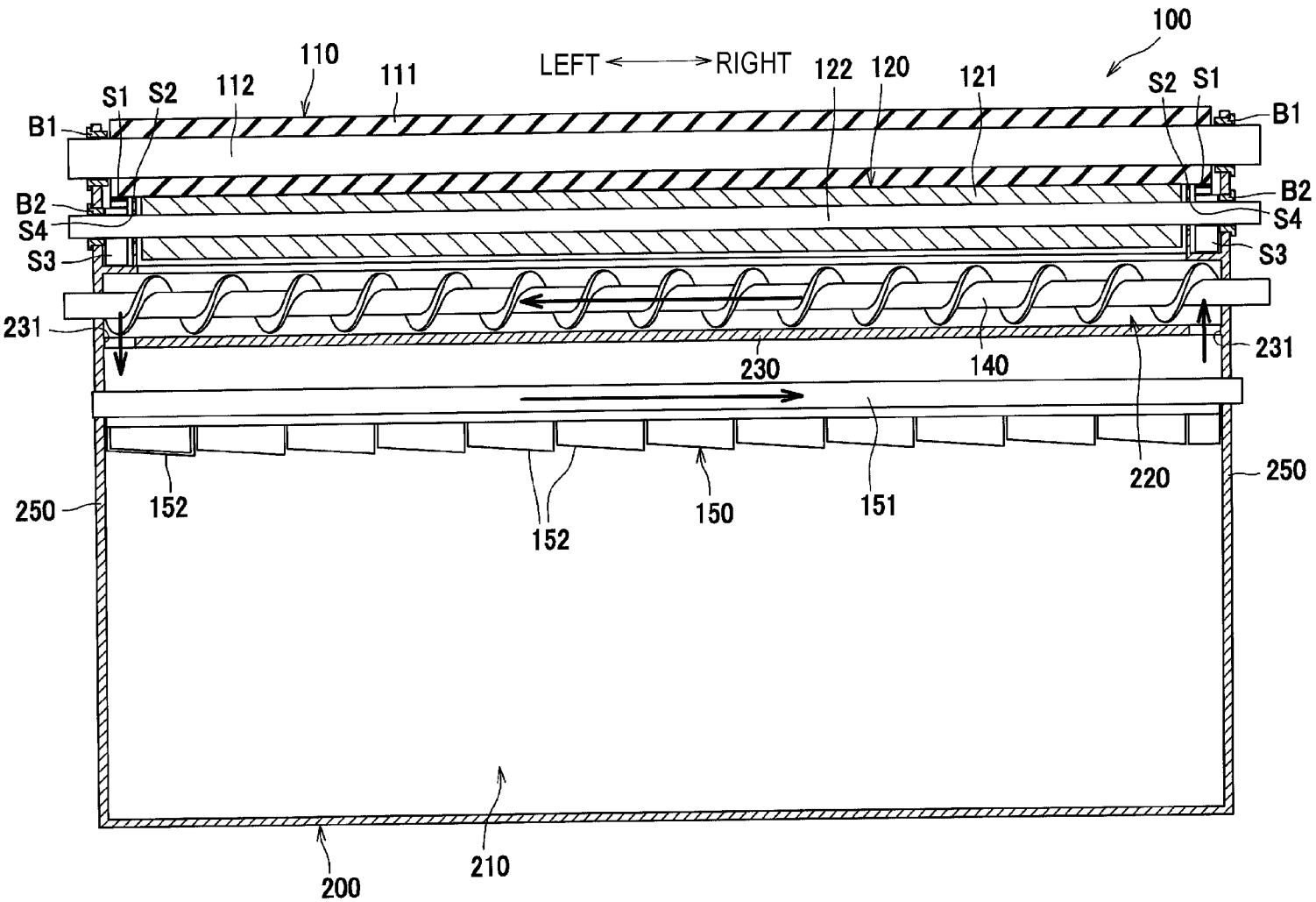
FIG. 4 is a sectional view taken along a line I-I of FIG. 3.

As shown in FIG. 4, the first communication hole 231 is an opening which is formed at each of left and right end portions of the partition wall 230. Although not shown, the second communication hole 232 may be an opening which is formed at one end portion of the partition wall 230 in the left-right direction or may be an opening which extends from the left end portion to the right end portion of the partition wall 230.

As shown in FIGS. 3 and 4, the rotating member 150 includes a base part 151 which is provided at a front side of the partition wall 230 and is rotatably supported to left and right side walls 250 of the developing frame 200 and a plurality of sheet members 152 which is fixed to the base part 151 and has flexibility.

The plurality of sheet members 152 are arranged in the left-right direction. Each sheet member 152 is formed to convey the toner T in the toner accommodation unit 210 from the left towards the right when the base part 151 is rotated in a clockwise direction in FIG. 3. In the meantime, the sheet member 152 arranged at a position facing the left first communication hole 231 is cut at its inner part, so that the conveying force thereof is reduced, as compared to the other sheet members 152. Thereby, it is possible to prevent the toner T, which has passed through the left first communication hole 231 and thus has been returned to the toner accommodation unit 210 from the developing unit 220, from being again returned to the developing unit 220 from the left first communication hole 231.

The rotating member 150 is rotated to agitate the toner T in the toner accommodation unit 210 and to cause the toner T in the toner accommodation unit 210 to move rightwards, thereby supplying the toner from the right first communication hole 231 to the space at a lower side than the partition 240 of the developing unit 220.

The developing roller 110 is arranged to be exposed outwardly through the opening 221 of the developing unit 220 and is rotatably supported to the developing frame 200. The developing roller 110 includes a cylindrical developing roller main body 111 extending in the left-right direction and a developing roller shaft part 112 which is inserted into the developing roller main body 111 and is rotatable integrally with the developing roller main body 111.

The developing roller main body 111 is formed of rubber, for example. The developing roller shaft part 112 is a cylindrical rod made of metal and extending in the left-right direction. The developing roller shaft part 112 has both left and right end portions protruding from the developing roller main body 111. The protruding portions are rotatably supported to the left and right side walls 250 of the developing frame 200 via bearings B1.

The supply roller 120 is a roller configured to rotate with contacting the developing roller 110 and is provided such that a rotational shaft (a center of rotation) thereof is arranged at a lower side than the contact part of the supply roller 120 and the developing roller 110.

The supply roller 120 includes a cylindrical supply roller main body 121 extending in an axial direction of the developing roller 110, i.e., the left-right direction, and a supply roller shaft part 122 which is inserted into the supply roller main body 121 and is rotatable integrally with the supply roller main body 121.

The supply roller main body 121 is formed of a urethane sponge, for example. The supply roller main body 121 has both left and right end surfaces which are positioned at inner sides of both left and right end surfaces of the developing roller main body 111 and the two first communication holes 231 formed at the partition wall 230 in the left-right direction.

The supply roller shaft part 122 is a cylindrical rod made of metal and extending in the left-right direction, for example. The supply roller shaft part 122 includes both left and right end portions protruding from the supply roller main body 121. The protruding portions are rotatably supported to the left and right side walls 250 of the developing frame 200 via bearings B2.

The supply roller 120 faces a tip of the partition 240 in the front-rear direction, and the contact part of the supply roller 120 and the developing roller 110 is positioned at an upper side than the partition 240.

The layer thickness regulation blade 130 has a plate shape extending in an axial direction of the developing roller 110. The layer thickness regulation blade 130 is fixed to the developing frame 200 in front of the developing roller 110, extends in the rear-lower direction from the fixed position and includes a tip arranged in front of the developing roller 110. The tip of the layer thickness regulation blade 130 is provided with a pressing part 131 protruding towards the developing roller 110. The pressing part 131 is configured to contact an outer peripheral surface of the developing roller 110.

The first auger 140 is positioned at a lower side than the partition 240 and is arranged to face the supply roller 120 and the first communication hole 231. The first auger 140 is rotated to move the toner T supplied from the first communication hole 231 from the right direction towards the left direction, thereby uniformly supplying the toner to the supply roller 120.

As shown in FIG. 3, the return conveyance member 160 is arranged at an upper side than the partition 240. The return conveyance member 160 includes a base part 161 rotatably supported to the developing frame 200 and a sheet member 162 fixed to the base part 161 and having flexibility.

The base part 161 of the return conveyance member 160 is rotated in a counterclockwise direction of FIG. 3, so that the sheet member 162 is moved with a tip thereof sliding-contacting the partition 240. Thereby, the toner T on the partition 240 is conveyed towards an opposite side to the developing roller 110, i.e., towards the toner accommodation unit 210 by the return conveyance member 160.

The second auger 170 is arranged between the return conveyance member 160 above the partition 240 and the second communication hole 232. The second auger 170 is rotated to move the toner T conveyed by the return conveyance member 160 towards the left or right direction, thereby returning the toner to the toner accommodation unit 210 through the second communication hole 232.

Figure 5:
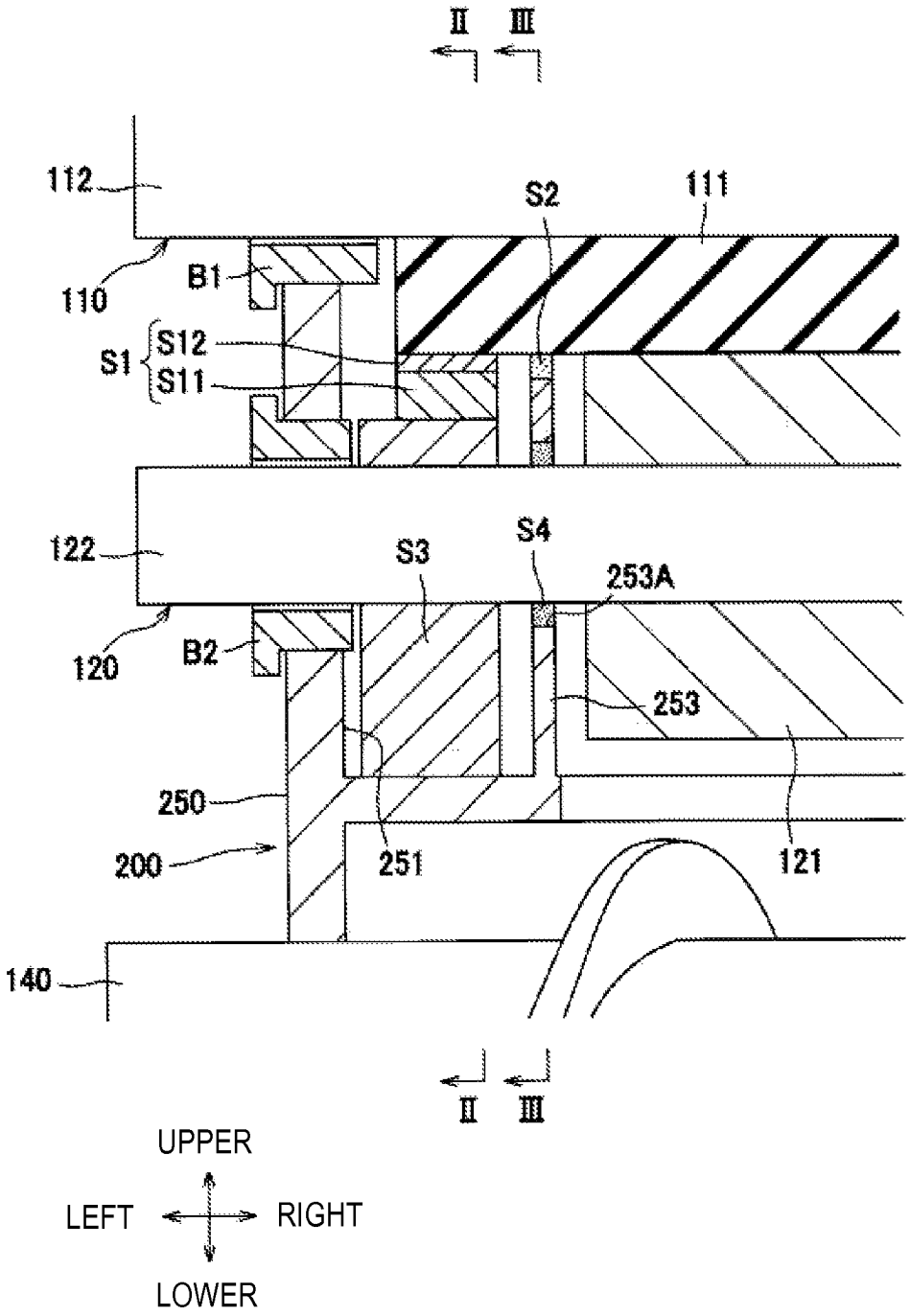
FIG. 5 is a sectional view showing a first seal member and a second seal member.

As shown in FIGS. 4 and 5, the developing cartridge 100 includes a first seal member S1 and a second seal member S2 arranged between the developing roller 110 and the developing frame 200 at each end portion of the developing roller 110 in the left-right direction (the axial direction). The developing cartridge 100 includes a third seal member S3 and a sponge member S4 arranged between the supply roller 120 and the developing frame 200 at each of left and right end portions of the supply roller 120.

Figure 6A:
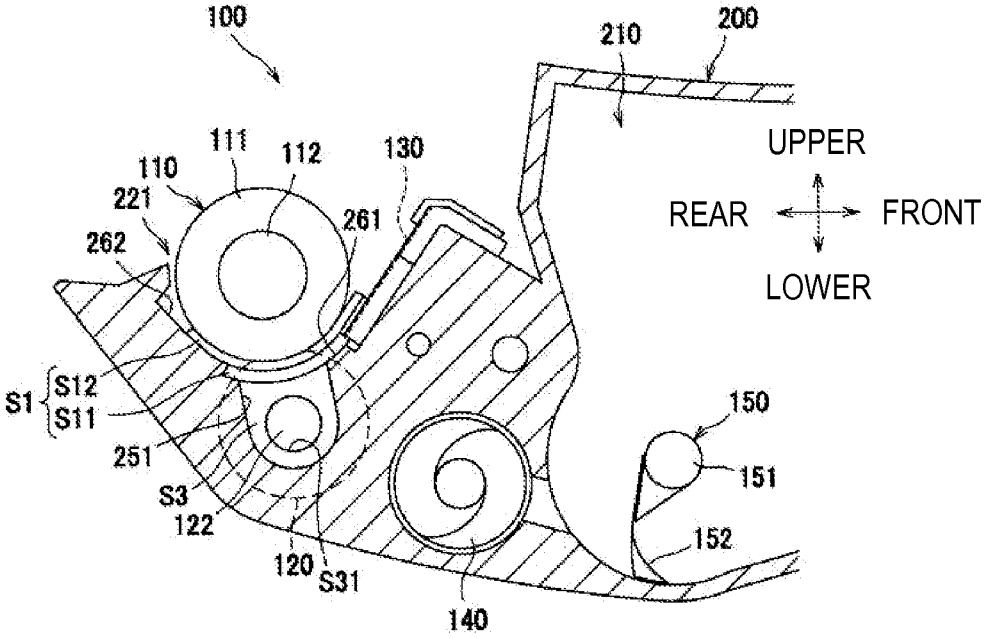
FIG. 6A is a sectional view taken along a line II-II of FIG. 5.

Specifically, as shown in FIG. 6A, the developing frame 200 includes a first adhesion surface 261, to which the first seal member S1 is adhered and which has a substantial arc shape as seen from the side, and a second adhesion surface 262, which is arranged at the rear end side of the first adhesion surface 261 (the opposite side to the layer thickness regulation blade 130) and has a substantial arc shape as seen from the side, at a position facing each end portion of the developing roller main body 111 in the left-right direction.

The first adhesion surface 261 extends from a vicinity of the tip of the layer thickness regulation blade 130 to a rear position of the contact part of the developing roller main body 111 and the supply roller 120.

The second adhesion surface 262 is a surface which is arranged at a closer position to the outer peripheral surface of the developing roller main body 111 than the first adhesion surface 261. That is, a step portion exists between the first adhesion surface 261 and the second adhesion surface 262, and a height of the step portion is set to be substantially the same as a thickness of a first elastic member S11 of the first seal member S1 (described later).

The first seal member S1 includes a contact member S12 configured to contact the developing roller main body 111 and the first elastic member S11 arranged between the contact member S12 and the first adhesion surface 261 of the developing frame 200.

The first elastic member S11 is an elastically deformable member made of a urethane sponge having a small compressive strain, for example. The first elastic member S11 has a shape conforming to the outer peripheral surface of the developing roller main body 111. The first elastic member S11 is adhered to the first adhesion surface 261.

That is, the first elastic member S11 is provided between the contact member S12 and the first adhesion surface 261, so that it is possible to urge the contact member S12 to the developing roller main body 111, thereby preventing generation of a gap between the contact member S12 and the developing roller main body 111.

The contact member S12 is a fiber member configured by felt made of polytetrafluoroethylene or fabric such as polyester fibers, for example, and is adhered to the first elastic member S11. The contact member S12 has a length larger than the first elastic member S11 in a circumferential direction of the developing roller 110. One end of the contact member S12 in the circumferential direction of the developing roller main body 111 protrudes outwardly further than the first elastic member S11 and is adhered to the second adhesion surface 262. The other end of the contact member S12 in the circumferential direction of the developing roller main body 111 protrudes outwardly further than the first elastic member S11 and is adhered to the layer thickness regulation blade 130. Incidentally, the contact member S12 may be directly adhered to the layer thickness regulation blade 130 or may be adhered to a seal member such as a urethane sponge adhered to the layer thickness regulation blade 130 and then adhered to the layer thickness regulation blade 130 via the seal member.

The first adhesion surface 261 is formed with a recess portion 251 which opens towards the outer peripheral surface of the developing roller main body 111 and in which the supply roller shaft part 122 is arranged. As shown in FIG. 5, the developing frame 200 includes a first wall part 253 which extends along the side wall 250 at the inner side of the side wall 250 in the left-right direction and configures an inner surface of the recess portion 251 in the left-right direction.

As shown in FIG. 6A, the third seal member S3 is fitted in the recess portion 251. The third seal member S3 is formed of a member having a high cushioning characteristic such as sponge and has a shape corresponding to the recess portion 251. The third seal member S3 is formed at its center portion with a hole portion S31 through which the supply roller shaft part 122 passes. The first elastic member S11 is adhered to an end surface of the third seal member S3 at a side of the developing roller main body 111.

Figure 6B:
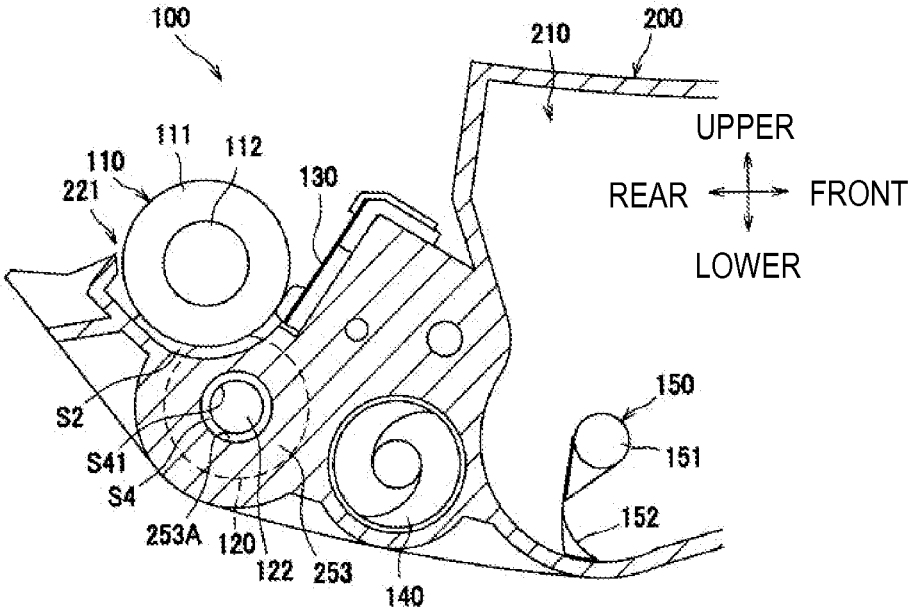
FIG. 6B is a sectional view taken along a line III-III of FIG. 5.

As shown in FIG. 6B, the first wall part 253 is formed with a hole 253A in which the supply roller shaft part 122 is arranged. In the hole 253A, the sponge member S4 having a shape corresponding to the hole 253A is provided. The sponge member S4 is formed at its center portion with a hole portion S41 through which the supply roller shaft part 122 passes.

The second seal member S2 configured to contact the outer peripheral surface of the developing roller main body 111 is adhered to an end surface of the first wall part 253 facing the outer peripheral surface of the developing roller main body 111. That is, the second seal member S2 is arranged between the developing roller main body 111 and the first wall part 253 of the developing frame 200 at the inner side of the first seal member S1 in the left-right direction.

The second seal member S2 is a second elastic member made of a sponge having a high cushioning characteristic and is elastically deformable. An elastic force of the second seal member S2 is smaller than that of the first elastic member S11. Thereby, a frictional force per unit area to be applied between the second seal member S2 and the developing roller main body 111 is smaller than a frictional force per unit area to be applied between the first seal member S1 and the developing roller main body 111.

As shown in FIG. 5, the first seal member S1 and the second seal member S2 are spaced in the left-right direction. The second seal member S2 is provided at an outer side of the end surface of the supply roller main body 121 in the left-right direction and is arranged at an interval from the end surface.

Operations and effects of the developing cartridge 100 are described.

As shown in FIG. 4, when the rotating member 150 is rotated, the toner T in the toner accommodation unit 210 passes through the right first communication hole 231 and is then supplied to the developing unit 220. Then, the toner T supplied to the developing unit 220 is supplied to the supply roller 120 by the first auger 140.

At this time, since the first communication hole 231 is arranged at the outer side of the supply roller main body 121 in the left-right direction, the first auger 140 can uniformly supply the toner T over the entire supply roller main body 121 in the left-right direction.

The toner T moved to the left end portion of the developing unit 220 by the first auger 140 is returned to the toner accommodation unit 210 by the left first communication hole 231. Thereby, it is possible to circulate the toner T in the developing cartridge 100 and to suppress the toner T from excessively remaining in the developing unit 220.

Also, as shown in FIG. 3, the toner T in the developing unit 220 is regulated as regards the height of the upper surface thereof by the partition 240 which is arranged at a lower side than the contact part of the developing roller 110 and the supply roller 120. Therefore, it is possible to suppress the toner T from remaining at the contact part of the developing roller 110 and the supply roller 120, i.e., in the vicinity of the outer peripheral surface of the developing roller main body 111.

As shown in FIG. 4, since the third seal member S3 and the sponge member S4 are provided between the supply roller shaft part 122 and the developing frame 200 at each of left and right end portions of the supply roller 120, it is possible to prevent the toner T in the developing unit 220 from being leaked from between the supply roller 120 and the developing frame 200.

The toner T supplied to the supply roller 120 is supplied to the developing roller 110 while being carried on the supply roller main body 121.

As shown in FIG. 3, the toner T carried on the developing roller 110 is scraped by the layer thickness regulation blade 130 to some extent. At this time, the scraped toner T is dropped to the vicinity of the supply roller 120 or onto the partition 240.

Since the return conveyance member 160 or the second auger 170 is provided at an upper side the partition 240, the toner T dropped on the partition 240 is sent to the opposite side to the developing roller 110 and is returned to the toner accommodation unit 210 through the second communication hole 232. Thereby, it is possible to suppress the toner T from remaining in the vicinity of the outer peripheral surface of the developing roller main body 111.

As shown in FIG. 5, since the second seal member S2 is provided between the developing roller main body 111 and the developing frame 200 at each of left and right end portions of the developing roller 110, it is possible to suppress the toner T from being leaked through between the developing roller 110 and the developing frame 200.

Since the second seal member S2 has the smaller frictional force per unit area to be applied with respect to the developing roller 110 than the first seal member S1, the frictional force is smaller at the contact part of the second seal member S2 and the developing roller 110. Thereby, it is possible to suppress the toner T from being melted due to frictional heat generated from the contact part of the second seal member S2 and the developing roller 110, so that it is possible to suppress the toner T from being affixed to the second seal member S2 and grinding the developing roller 110.

Further, even though the toner T is leaked through the contact part of the second seal member S2 and the developing roller 110, it is possible to block the leaked toner T by the first seal member S1 arranged at the outer side of the second seal member S2 in the left-right direction. Thereby, it is possible to securely prevent the leakage of the toner T.

Further, since the second seal member S2 and the first seal member S1 are spaced in the left-right direction, it is possible to drop the toner T leaked from the part, at which the second seal member S2 is provided, between the first seal member S1 and the second seal member S2. Thereby, since the toner T does not reach the first seal member S1, it is possible to suppress the toner T from being melted and affixed to the first seal member S1 due to the frictional heat generated from the contact part of the first seal member S1 and the developing roller 110.

Further, since the second seal member S2 is provided at the outer side of the end surface of the supply roller main body 121 in the left-right direction and is arranged at an interval from the end surface, the toner T is not supplied to the vicinity of the second seal member S2 from the supply roller 120. That is, since an amount of the toner T reaching between the second seal member S2 and the developing roller main body 111 is reduced, it is possible to suppress the toner T from being leaked between the second seal member S2 and the developing roller main body 111.

While the present invention has been shown and described with reference to certain illustrative embodiments thereof, it will be understood by those skilled in the art that various changes in form and details may be made therein without departing from the spirit and scope of the invention as defined by the appended claims.

Incidentally, in the below descriptions, the substantially same configurations as the above illustrative embodiment are denoted with the same reference numerals and the descriptions thereof are omitted.

Figure 7:
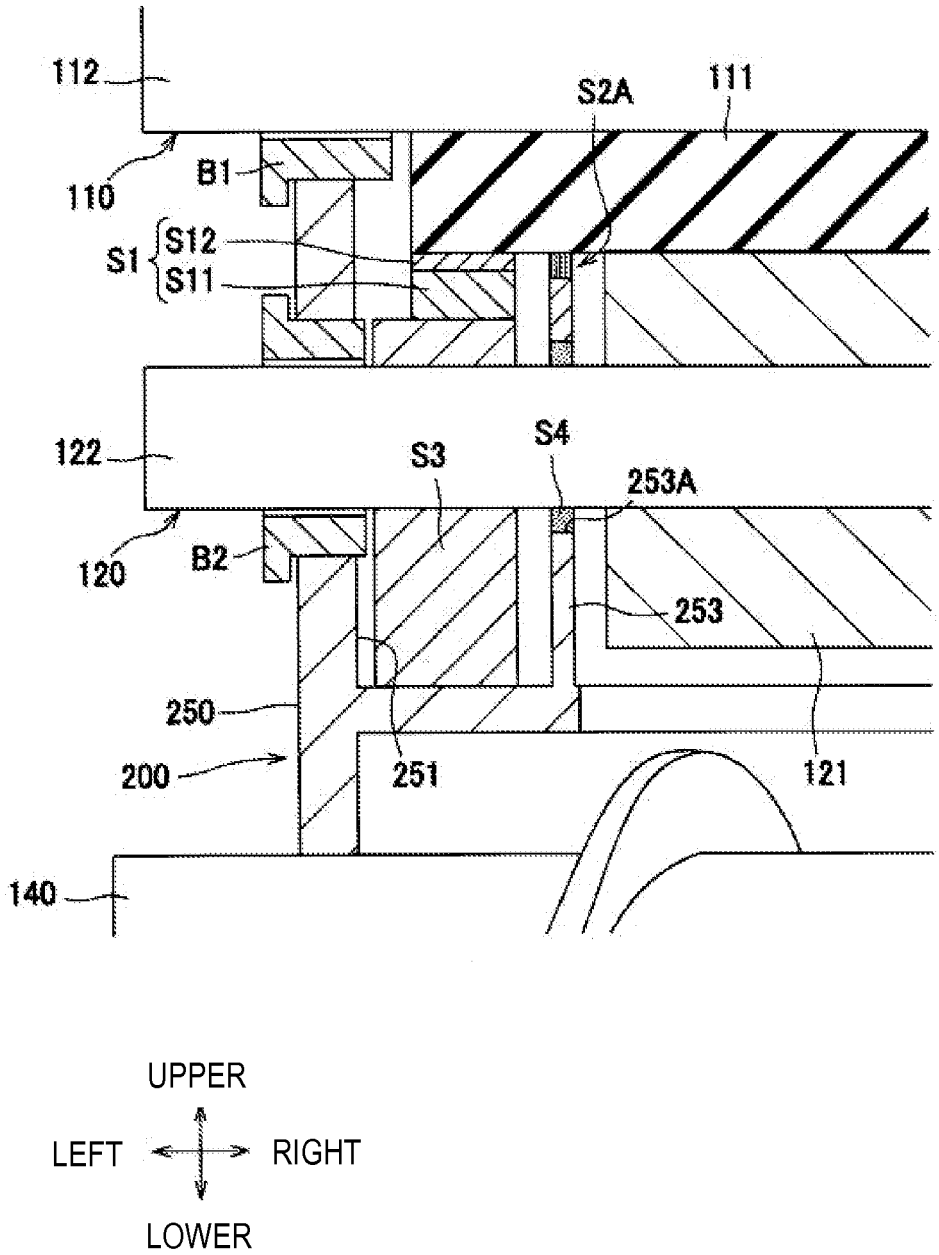
FIG. 7 is a sectional view showing a second seal member according to a first modified illustrative embodiment.

In the above illustrative embodiment, the second elastic member made of the sponge is exemplified as the second seal member S2. However, the configuration of the second seal member S2 is not limited thereto. For example, as shown in FIG. 7, the second seal member may be a brush S2A including a plurality of fiber-shaped members.

The brush S2A is configured such that base ends of the plurality of fiber-shaped members are fixed to the developing frame 200 and tips of the plurality of fiber-shaped members contact the circumferential surface of the developing roller 110. The brush S2A has a smaller frictional force per unit area to be applied with respect to the developing roller main body 111 than the first seal member S1.

That is, even when the brush S2A is adopted as the second seal member, the frictional force per unit area to be applied between the brush S2A and the developing roller 110 is smaller than the first seal member S1, so that it is possible to suppress the toner T from being melted and affixed due to the heat generated from the contact part of the brush S2A and the developing roller 110.

Figure 8:
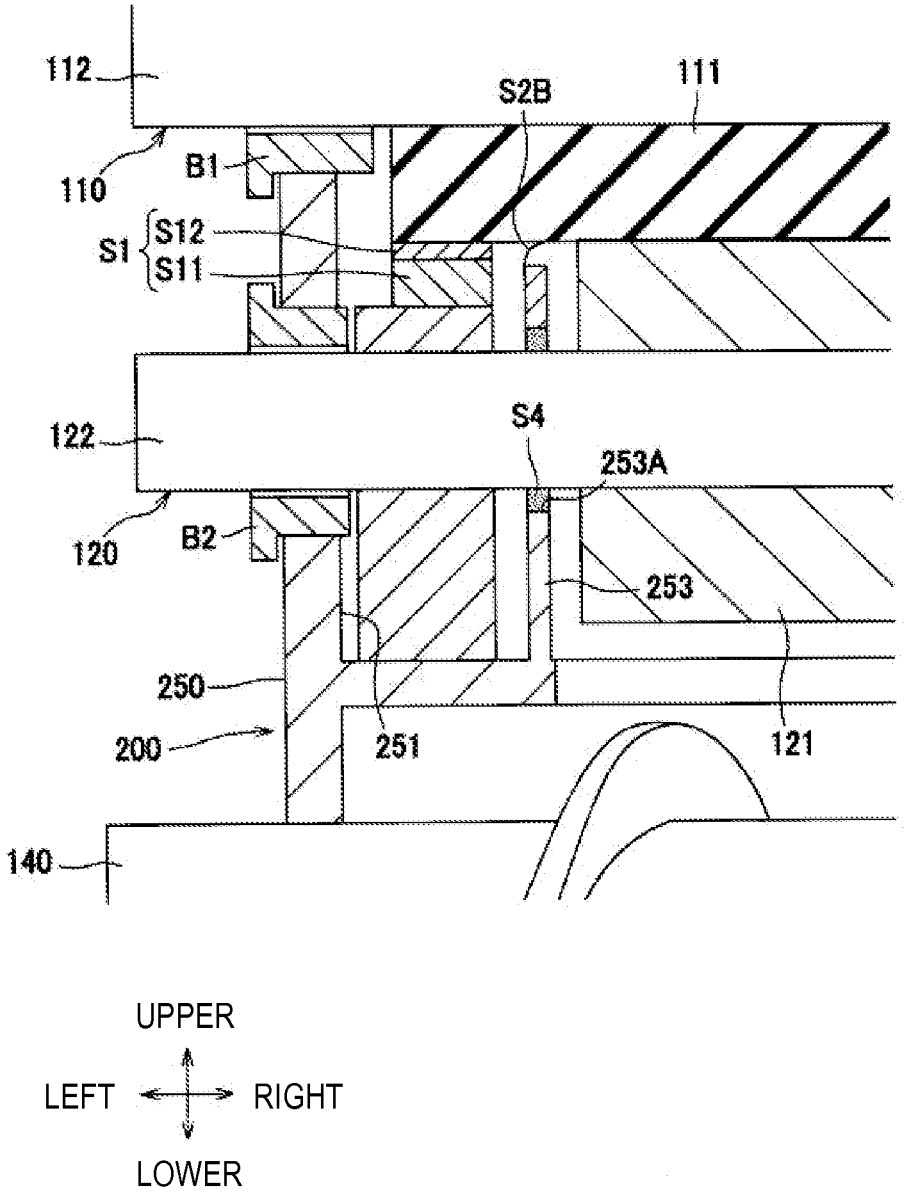
FIG. 8 is a sectional view showing a second seal member according to a second modified illustrative embodiment.

Further, as shown in FIG. 8, the second seal member may be a film S2B including a base end fixed to the developing frame 200 and a tip configured to contact the developing roller 110. The film S2B is a member having flexibility and the tip thereof is bent towards the inner side in the left-right direction. The film S2B has a smaller frictional force per unit area to be applied with respect to the developing roller main body 111 than the first seal member S1.

That is, even when the film S2B is adopted as the second seal member, the frictional force per unit area to be applied between the film S2B and the developing roller 110 is smaller than the first seal member S1, so that it is possible to suppress the toner T from being melted and affixed due to the heat generated from the contact part of the film S2B and the developing roller 110.

Further, since the tip of the film S2B is bent towards the inner side in the left-right direction, it is more difficult for the toner T to be leaked outwards from the inner side in the left-right direction through between the film S2B and the developing roller 110, as compared to a configuration where the tip is bent towards the outer side in the left-right direction.

In the above illustrative embodiment, the inventive concept of the present invention is applied to the developing cartridge 100 of the multi-function machine 1. However, the inventive concept of the present invention can be applied to a developing device of a monochrome or color laser printer.

Further, as shown in FIG. 5, a length of the first seal member S1 in the axial direction may be longer than a length of the second seal member S2 in the axial direction. Moreover, the length of the first seal member S1 in the axial direction may be longer than two times the length of the second seal member S2 in the axial direction.

What is claimed is:

1. A developing device comprising:
a developing roller;
a housing configured to support the developing roller;
a first seal member arranged between the developing roller and the housing at each end portion of the developing roller in an axial direction thereof; and
a second seal member arranged between the developing roller and the housing at an inner side of the first seal member in the axial direction and having a smaller frictional force per unit area to be applied than the first seal member with respect to the developing roller.

2. The developing device according to claim 1,
wherein the first seal member and the second seal member are spaced in the axial direction.

3. The developing device according to claim 1,
wherein the first seal member includes:
a contact member configured to contact the developing roller; and a first elastically-deformable elastic member arranged between the contact member and the housing, and configured to urge the contact member towards the developing roller, wherein the second seal member is made of a second elastically-deformable elastic member, and wherein an elastic force of the second elastic member is smaller than that of the first elastic member.

4. The developing device according to claim 1, wherein the second seal member is made of a brush.

5. The developing device according to claim 1, wherein the second seal member is made of a film including a tip configured to contact the developing roller.

6. The developing device according to claim 5, wherein the tip of the film is bent towards an inner side in the axial direction.

7. The developing device according to claim 1, further comprising:

a supply roller configured to contact the developing roller, wherein a rotational shaft of the supply roller is arranged at a lower side than a contact part of the supply roller and the developing roller.

8. The developing device according to claim 7, further comprising:

a first conveying member arranged to face the supply roller and configured to convey developer towards the supply roller; and a wall arranged at an upper side of the first conveying member and at a lower side of the contact part of the supply roller and the developing roller.

9. The developing device according to claim 8, further comprising:

a second conveying member arranged at an upper side of the wall and configured to convey developer on the wall towards an opposite side to the developing roller.

10. The developing device according to claim 7, wherein the second seal member is arranged at an interval from an end surface of the supply roller in the axial direction.

11. The developing device according to claim 1, wherein the second seal member includes a sponge.

12. The developing device according to claim 11, wherein the first seal member includes polytetrafluoroethylene fibers.

13. The developing device according to claim 11, wherein the first seal member includes polyester fibers.

14. The developing device according to claim 1, wherein a length of the first seal member in the axial direction is longer than a length of the second seal member in the axial direction.

15. The developing device according to claim 14, wherein the length of the first seal member in the axial direction is longer than two times the length of the second seal member in the axial direction.

* * * * *